United States Patent [19]

Switall

[11] Patent Number: 4,823,987

[45] Date of Patent: Apr. 25, 1989

[54] LIQUID MIXING SYSTEM AND METHOD

[75] Inventor: Thomas G. Switall, Wheeling, Ill.

[73] Assignee: Ryco Graphic Manufacturing, Inc., Wheeling, Ill.

[21] Appl. No.: 856,403

[22] Filed: Apr. 28, 1986

[51] Int. Cl.[4] ..... B67D 5/08

[52] U.S. Cl. ..... 222/63; 222/64; 222/65; 222/66; 222/155; 222/318; 366/132; 366/134; 366/142; 366/152; 366/153; 366/160; 137/101.25; 137/391; 137/392

[58] Field of Search ..... 340/61 B; 73/323, 313, 73/301

[56] References Cited

U.S. PATENT DOCUMENTS

| | | | |
|---|---|---|---|
| 2,243,188 | 5/1941 | Biach | 137/391 |
| 2,660,059 | 11/1953 | Dean et al. | 73/313 |
| 3,553,575 | 1/1971 | Shea | 73/304 C X |
| 3,628,617 | 12/1971 | Ferrigan | 222/318 X |
| 4,091,834 | 5/1978 | Frigato | 137/93 |
| 4,121,767 | 10/1978 | Jensen | 137/93 X |
| 4,258,444 | 3/1981 | Orszullok | 137/392 X |
| 4,259,975 | 4/1981 | Kinsey, Jr. et al. | 222/155 X |
| 4,262,776 | 4/1981 | Wilson et al. | 137/93 X |
| 4,362,033 | 12/1982 | Young | 222/64 X |
| 4,456,149 | 6/1984 | Sciortino | 222/63 X |
| 4,474,476 | 10/1984 | Thomsen | 366/153 X |
| 4,609,127 | 9/1986 | Hart | 222/66 |

*Primary Examiner*—Michael S. Huppert
*Assistant Examiner*—David H. Bollinger

[57] ABSTRACT

A liquid mixing system and method are disclosed for automatically preparing a batch mixture containing predetermined quantities of liquids such as spray dampening solutions or silicone emulsions used in the printing industry. The system comprises a holding tank having one or more liquid columns in liquid communication with the tank so that the level of liquid in the column, or columns, will be the same as the level of the liquid in the tank. Liquid level detection devices preferably in the form of static capacity-type proximity switches sense the level of the liquid in the column, or columns, and liquid charging devices responsive to the liquid level detection devices charges the liquids into the tank in seriatum each time raising the level of the liquid in the tank and in the columns to the next detected level. The tank liquids are mixed preferrably by an external mixing device which also operates to discharge the liquid mixture from the tank through a three-way valve operating in response to the liquid detection devices.

13 Claims, 3 Drawing Sheets

LIQUID MIXING SYSTEM AND METHOD

BACKGROUND OF THE INVENTION

This invention pertain to a mixing system and method for batch mixing and dispensing liquids such as dampening solutions or silicone emulsions used in the printing industry. The mixing system is useful in providing the spray dampening fluid for the spraying system of co-pending application Ser. No. 518,470, filed July 29, 1983, entitled "Variable Frequency Spray Dampening System". The system is also useful in providing a silicone emulsion of the type applied to a paper web as the web is moving through a printing press such system being described in co-pending application Ser. No. 770,104, filed Aug. 28, 1985, and entitled "Apparatus and Method for Applying Silicone Emulsion to a Paper Web".

In preparing either a spray dampening solution or a silicone emulsion, quantities of the constituent liquids are charged into a mixing tank and mixed as a batch. It is highly desirable, however, to automate this process so that when the batch mixture has been discharged from the system, the system will automatically begin mixing another batch. One such mixing system for dampening solutions is disclosed in co-pending application Ser. No. 647,893, filed Sept. 6, 1984, entitled "Liquid Mixing System". This system discloses a process for continuous batch mixing in a mixing vessel and discharging into a feed tank which is constantly under pressure. Other mixing system have required complex proportional mixing devices such as liquid motor drives and metering pumps as well as loss motion pumps. Not only were such systems complex, but they required sensing devices which were usually emersed in the liquids and thus subject to corrosion, contamination and coating which would create inaccuracies in devices. Moreover, with the prior art systems, adjustments or variations in the amounts of the liquids were difficult or required complex counters or adjustable metering devices which were difficult to maintain in proper working order.

SUMMARY OF THE INVENTION

The present invention provides a much less complex mixing system which obviates expensive metering devices, complex counters and adjustment mechanisms, and totally isolates most of the sensing devices from the liquids being mixed. The system permits accurate, easily adjustable charging of the quantities of liquids being mixed and provides a unitary mixing and discharge system which automatically remixes the next batch when the previous batch has been discharged.

The system of this invention automatically prepares a batch mixture of liquids, and for this purpose, a liquid holding tank is provided and at least one liquid column is mounted outside of the tank in fluid communication with the interior of the tank. Thus, the level of the liquid in the column will be the same as the level of the liquid in the tank. Liquid level detection means is provided for detecting at each of several predetermined levels the presence of liquid in each column at that level. Liquid charging means responsive to the liquid level detection means charges separately and in seriatum a plurality of liquids into the tank each liquid being charged in a quantity sufficient to raise the liquid in the column or columns from one predetermined level to the next. Liquid transport means responsive to the liquid level detection means mixes the fluids which have been charged into the tank and discharges the liquid mixture from the tank after the liquids have been charged into the tank and mixed. Each liquid column is preferably of a transparent, non-metallic material, and the liquid level detection means comprises one or more detectors in the form of static capacity type proximity sensors or switches mounted on the exterior of the column for sensing the presence of fluid within the column at the level at which the detector is located.

Means is also preferably provided for vertically moving one or more of the sensors relative to the others so that the predetermined levels at which liquid is detected in the associated column can be readily changed.

In the case where one of the liquids alters the conductivity of the liquid mixture (such as for example, in mixing a dampening solution) a conductivity detection means is provided for detecting the electrical conductivity of the liquid mixture and means responsive to the conductivity detection means is provided for charging a conductivity altering liquid such as a dampening solution concentrate or etch into the tank during the mixing operation.

The mixing process of the invention comprises sensing the liquid level in a mixing tank at a plurality of predetermined levels by means totally isolated from the liquid within the tank, charging liquids into the tank separately and in seriatum with each liquid being charged in a quantity sufficient to raise the liquid in the tank from one predetermined level to the next, mixing the liquids which have been charged into the tank and discharging the liquid mixture into the tank after the liquids have been charged into the tank and mixed. The process may also include the steps of sensing the conductivity of the tank liquid and charging a conductivity altering solution into the tank during the time one of the liquids is being charged into the tank.

DETAILED DESCRIPTION OF THE PREFERRED EMBODIMENTS

Figure 1:
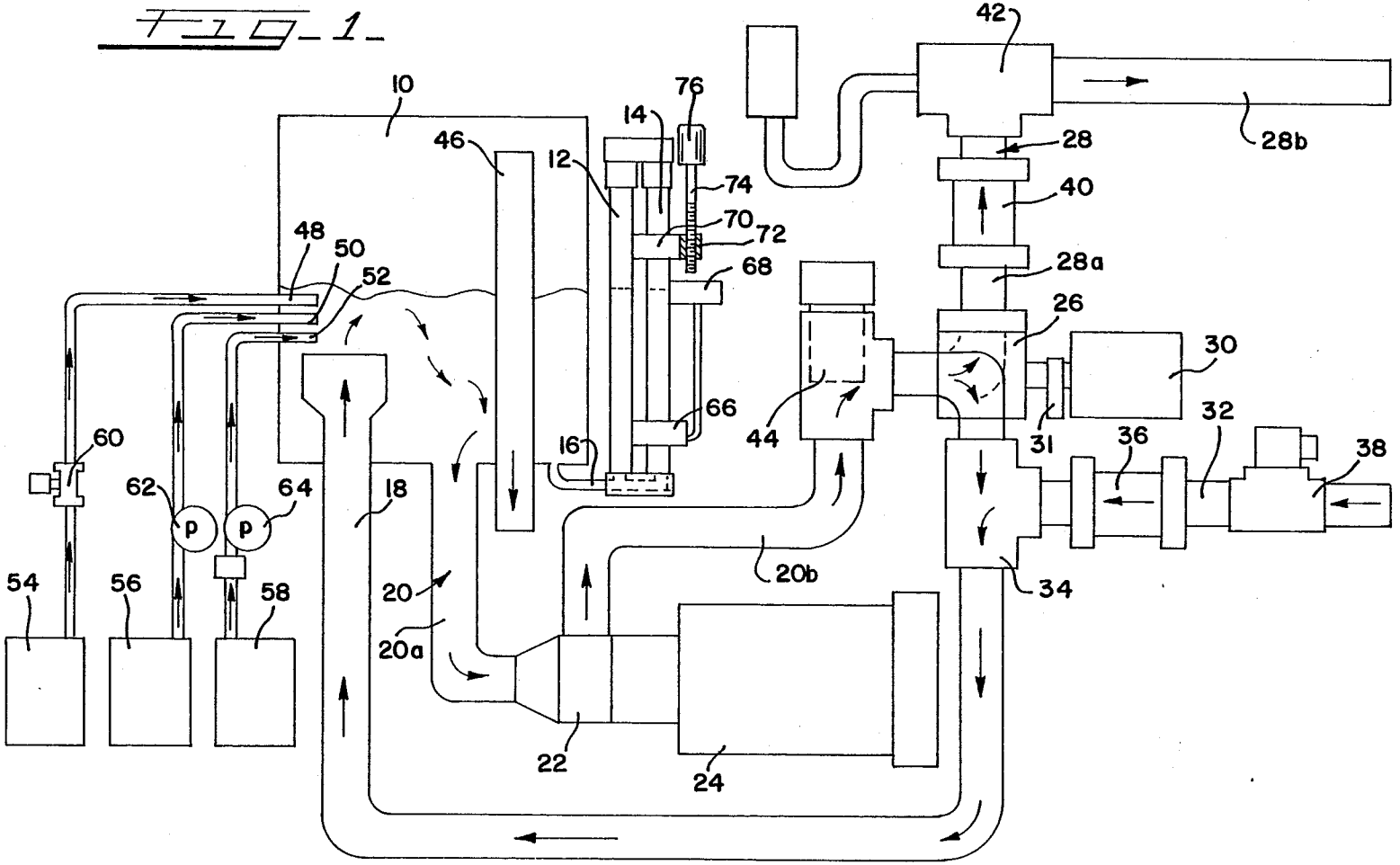
FIG. 1 is a schematic flow diagram of a mixing system constructed in accordance with this invention.

The system for automatically preparing a batch mixture of liquids is shown schematically in FIG. 1 and includes a liquid mixing tank 10 and a pair of liquid columns 12 and 14 which are in fluid communication with the interior of the mixing tank 10 by means of a connecting pipe 16. Thus, the level of the liquid in each of the columns 12 and 14 will be the same as the level of liquid in the tank 10. Entering through the bottom of the mixing tank is an in-flow conduit 18, and also communicating with the bottom of the mixing tank 10 is an outflow conduit 20 consisting of a first segment **20*a* and a second segment 20*b*. Between the two segments 20*a*** and 20*b* of the out-flow conduit is a pump 22 operated by means of a motor 24 such that when the motor 24 is energized, the pump will pump liquid in the direction of the arrows through the out-flow conduit 20. The second segment 20*b* of the out-flow conduit is connected to a three-way valve 26. The valve 26 is in fluid communication with a discharge conduit 28 consisting of a first segment 28*a* and second segment 28*b*, and the valve is also in fluid communication with the outer end of the in-flow conduit 18. The three-way valve is operated by means of a motor 30 and the position or operating mode of the valve is sensed by microswitches 31. When the valve is in a mixing mode, it places the second segment 20*b* of the out-flow conduit in fluid communication with the in-flow conduit 18 and thus liquid is withdrawn from the tank through the out-flow conduit and recirculed back to the tank through the in-flow conduit. A water supply line 32 is also connected to the in-flow conduit 18 by means of a T-connection 34 and a check valve 36 prevents backflow into the water line. Flow through the water line 32 in the direction of the arrows is controlled by means of a water valve 38.

In the first segment 28(*a*) of the discharge conduit, there is also a check valve 40, and between the segments 28*a* and 28*b* of the discharge conduit there is a pressure sensor 42 which senses the pressure within the discharge conduit. Within the second segment 20*b* of the out-flow conduit, there is a conductivity sensor 44 for sensing the conductivity of the liquid passing through the second segment of the out-flow conduit.

Also extending up through the bottom of the mixing tank 10 and terminating adjacent the top of the tank is an overflow conduit 46, the lower end of which is connected to a sewer pipe (not shown). This prevents the tank from overflowing should the amount of the liquid in the tank reach the top of the overflow conduit 46.

Extending in through the side of the tank are liquid charging pipes 48, 50 and 52 which are respectively connected to supply tanks 54, 56 and 58 in the particular embodiment illustrated, which is a mixer for preparing a dampening solution. The supply tank 54 may, for example, be a pressurizable tank containing a liquid, such as alcohol, and the supply tanks 56 and 58 are tanks or drums which may contain dampening solution concentrate. Since the supply tank 54 is pressurizable in this embodiment, a valve 60 controls the flow of alcohol from the supply tank 54 through the charge pipe 48 into the mixing tank 10. If desired, the tank 54 could be at ambient pressure and a pump could be substituted for the valve 60. For supplying the dampening solution concentrate or etch, a pair of pumps 62 and 64 are employed and it is preferred that there be provided a drum switching system such as disclosed in co-pending application Ser. No. 770,104, filed Aug. 28, 1985, entitled "Apparatus and Method for Applying Silicon Emulsion to a Paper Web". This type of drum switching is accomplished by means of vacuum switches (not shown) which sense the presence of the etch concentrate in the charging pipe 50, when the pump 62 has been turned on. If there is no etch concentrate in that pipe, the pump 62 is deenergized and the pump 64 for tank 58 and charging pipe 52 is energized. Etch solution will be pumped from the tank 58 until that tank is empty and the vacuum switch in charging pipe 52 will sense this and switch back to tank 56 which by this time has been refilled. Thus, one of the tanks 56 will be in the process of being emptied or empty while the other supply tank or drum 58 is full or being filled.

Of course, if the system is used for mixing solutions other than dampening solutions, the supply tanks 56 and 58 may contain different liquids.

One of the features of the invention is the invention is the means for detecting the liquid level in the preferably transparent, non-metallic columns 12 and 14. This is preferably accomplished by means of static capacity type proximity switches or sensors 66, 68 and 70. This type of sensor senses nonmetallic objects and is preferably type F2K produced by Omron Tatsisi Electronics Co. of Japan. One type of sensor is described in U.S. Pat. No. 3,553,575. In the illustrated embodiment, the lower sensor or proximity switch 66 is located adjacent the bottom of the column 12 and senses whether there is liquid present in the column 12 and in the tank 10 at that level. Thus it senses when the mixing tank 10 is substantially empty. The proximity switch or sensor 68 senses when there is liquid in the tank at a second predetermined level. In this embodiment both the proximity switch 66 and the proximity switch 68 are mounted in relatively fixed position. By contrast, the proximity switch 70 is mounted for adjustable movement on a carriage which includes an internally threaded nut member 72 in threaded engagement with the externally threaded portion of a motor shaft 74 operated by means of a reversible motor 76. Thus, operation of the motor 76 in one direction will raise the carriage member 72 and the proximity switch 70 carried thereon, and operation of the motor 76 in the opposite direction will lower the proximity switch 70. The proximity switch 70 senses a third predetermined level of liquid in the tank 10.

Figure 2:
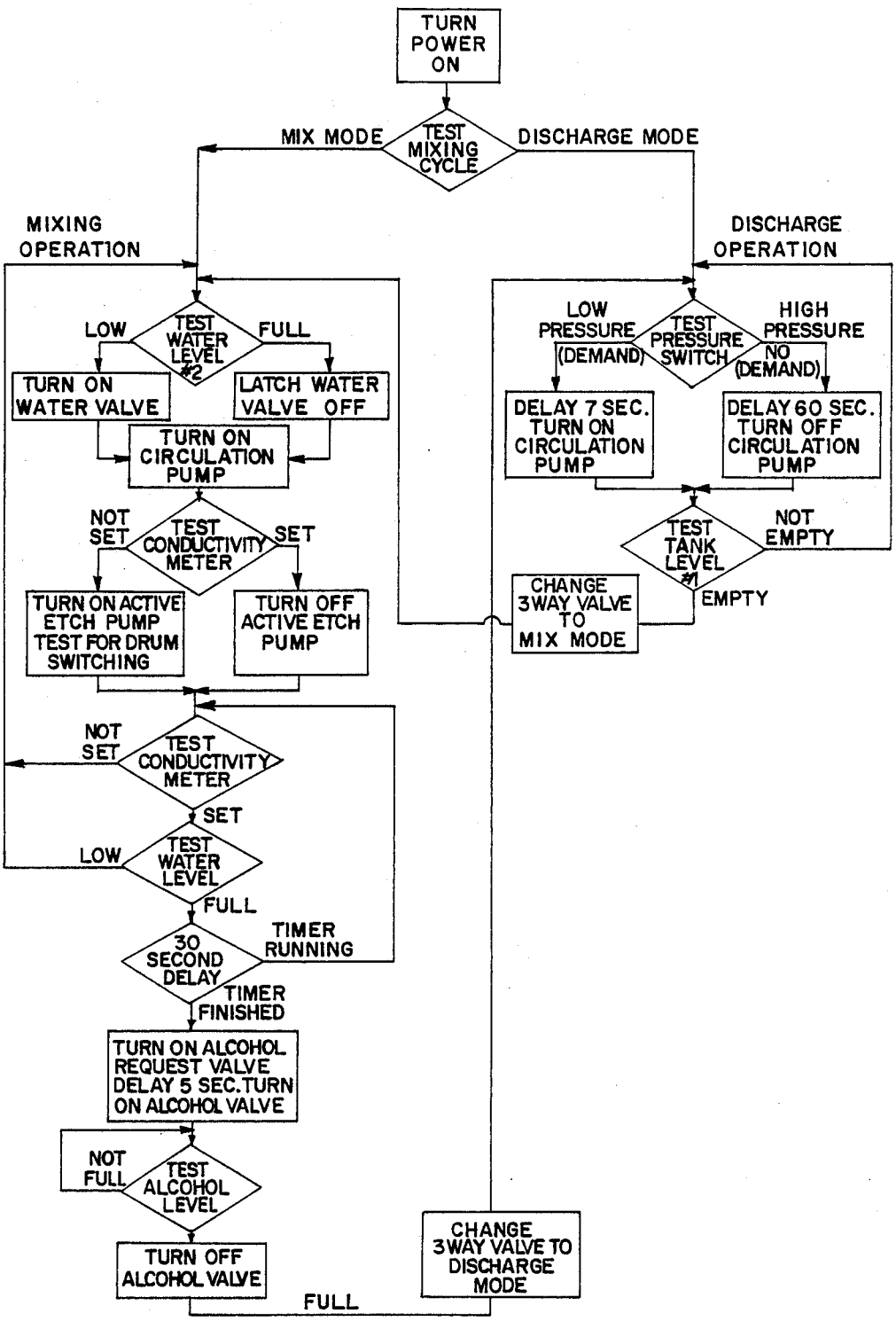
FIG. 2 is an operational chart of the system of FIG. 1.

FIG. 2 is an operational chart for the system just described. When the power is turned on, the system senses through micro-switches 31 of the valve motor 30 the position of the three-way valve 26. If the three-way valve is in the mixing mode in which the second segment of the out-flow conduit 20*b* is in fluid communication with the in-flow conduit 18 to recirculate the liquid from the mixing tank 10, then the microswitches 31 will sense this and the mixing operation will proceed If the microswitch (valve position) sensors 31 indicate that the three-way valve 26 is in the discharge mode with out-flow conduit segment 20*b* in fluid communication with the discharge conduit 28, then the system will proceed with its discharge operation.

In the mixing operation, the system first tests the water level through the proximity switch sensor 68. If there is water at this level, then the water valve 38 is latched "off" and the circulation pump motor 24 if it is not then on will be turned on to recirculate liquid from the mixing tank 10 out through out-flow conduit 20 and back through the in-flow conduit 18. If on the other hand the sensor 68 does not detect water at this predetermined level, the water valve 38 is turned on, and if and when the liquid is present at the level at which sensor 66 is positioned, the circulation pump motor 24 is energized to start the recirculation of liquid.

The next test is the conductivity by means of the conductivity probe or sensor 44. If the conductivity is not adequate, then either the pump 62 or the pump 64 is turned on, depending upon the drum switching operation, delivering dampening solution (etch) concentrate to the mixing tank 10 through the charging pipe 50 (or 52) as the case may be. If the conductivity of the liquid flowing through the second segment of the out-flow conduit 20*b* is sensed by the conductivity sensor 44 to be adequate, then the etch pump 62 (or 64) is turned off. The conductivity is again sensed at this point and, of course, it may change due to the flow of fresh water into the system or due to the mixing operation. If the conductivity is not adequate, or if the water level has not reached the level of sensor 68, and the operation is recycled to again test the water level and test the conductivity level, and this continues until both the conductivity as sensed by the sensor 44 and the water level as sensed by sensor 68 are both proper. At this point there is a 30 second delay during which time the mixing continues and if at the end of that time period the conductivity and water level are still in proper order, the next liquid which in the illustrated embodiment is alcohol, is charged into the tank through the pipe 48. In most cases the alcohol would be delivered under pressure, but the pressure would be only maintained when the alcohol is required by the system. The first step in the alcohol delivery is thus the pressurizing of the alcohol supply tank 54, and after a 5 second delay, the control valve 60 is turned on to deliver the alcohol through the pipe 48 to the tank 10. Alcohol continues to be delivered throug the valve 60 and the pipe 48 until the liquid level in the tank 10 and the columns 12 and 14 reaches the level of the third static capacity-type proximity switch 70, and at this time the alcohol valve will be turned off and the supply tank 54 will be depressurized. The tank 10 is completely full, all of the liquids having been charged into the tank and thoroughly mixed. At this point, the valve motor 30 is then energized to turn the three-way valve 26 from the mix mode to the discharge mode and the discharge proceeds.

In the discharge operation, the pressure in the discharge conduit 28 is sensed by the pressure sensor 42 and if the pressure is low, then the pump motor 24 is energized if it is not already energized to cause the liquid to be pumped through the second segment of the out-flow conduit **20*b* and out through the discharge conduit 28**.

If, however, in this first test of the discharge operation the pressure sensor 42 senses a high pressure in the discharge conduit 28, signifying that the discharge of the liquid mixture is being held up, then after a 60-second delay the pump motor 24 is deenergized. At this point, the sensor 66 at the bottom of the column 12 will sense whether or not liquid is present at that level, i.e. whether the tank 10 and columns 12 and 14 are empty. If they are not empty, then the discharge operation will recycle back to its start to test the pressure in the discharge conduit by means of the pressure sensor 42, and if at this time, the pressure is low, then the circulation pump is again switched on and the discharge continues until sensor 66 indicates that the column 12 and the tank 10 are empty, at which time the motor 30 for the valve 26 is energized to switch the valve to its mixing mode and the mixing operation proceeds to prepare the next batch of liquids.

Figure 3:
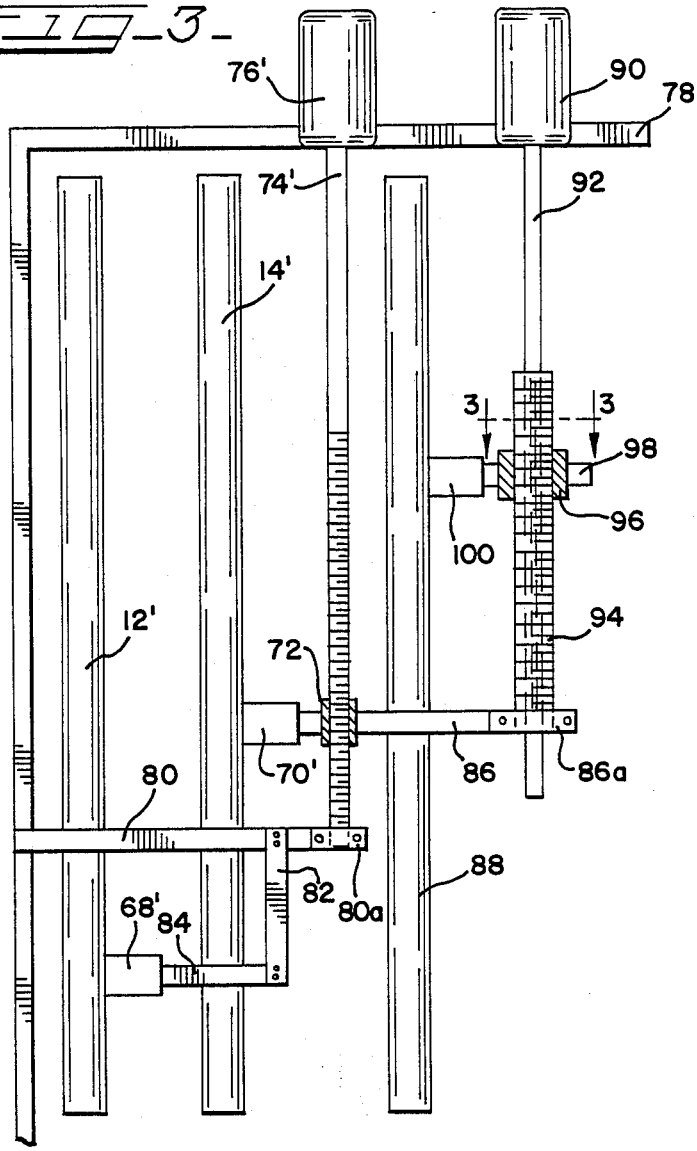
FIG. 3 is an enlarged elevational view, partially in section, of the liquid columns and liquid level sensing means of a slightly modified three liquid mixing system showing schematically the manner in which the detectors of the liquid level detection means may be moved relative to one another.

In FIG. 3, there is shown a slightly modified mounting and operation of the static capacity-type proximity switches. Whereas, in the embodiment of FIG. 1 only the upper proximity sensor 70 is adjustable by means of a motor 76, in FIG. 3, there are two top proximity sensors which are movable with respect to the fixed proximity sensors and with respect to each other. In this embodiment, there is attached to the system frame 78 a horizontal bar 80 from which are suspended vertical and horizontal support members 82 and 84, mounting the upper water limit proximity switch 68' in fixed position relative to the first column 12'. Also mounted on the frame 78 is a motor 76' having an elongated shaft 76' which is externally threaded. The threaded shaft 74' is in threaded engagement with an internally threaded member 72 affixed to a carriage 86 on which is mounted a static capacity-type proximity switch 70'. The lower end of the motor shaft 74' is journalled in a bearing **80*a* carried by the support 80**.

Figure 4:
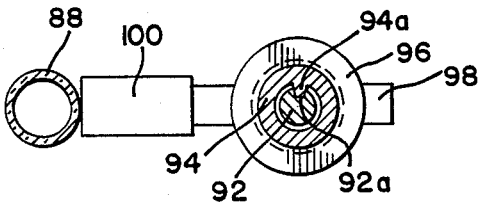
FIG. 4 is a sectional view of the liquid columns and liquid level sensing means taken along line 3—3 of FIG. 3.

In this embodiment, there is provided a third liquid column 88 which like the other columns 12' and 14' is in fluid communication with the interior of the mixing tank 10. Also a second motor 90 mounted on the frame 78 has a shaft 92 having a longitudinal (vertical) spline or key way **92*a* cut therein. Mounted on this splined shaft 92 is a bushing 94 having a longitudinally extending key 94*a* in sliding engagement with the spline 92*a* of the motor shaft. This is best illustrated in the cross sectional view of FIG. 4. The bushing 94 is journalled in a bearing 86*a* carried by the first carriage 86 and the lower end of the shaft 92 extends through this bearing. The bushing 94 is externally threaded and is in threaded engagement with an internally threaded member 96 affixed to a second carriage 98 on which is mounted a fourth static capacity-type proximity sensor 100. This sensor the presence of liquid at a predetermined level in the column 88. The embodiment of FIG. 3 is adapted to mix fluids such as a silicone emulsion and in that type of a mixer the second proximity sensor 68' senses the upper limit of the water, the third proximity sensor 70' senses the upper limit of the silicone emulsion concentrate and the fourth proximity sensor 100** senses the level of the anti-static liquid.

This arrangement permits the amount of liquid, in this case, silicone emulsion to be adjusted by moving the third (silicone) sensor 70' up or down relative to the second (water) sensor 68' without effecting the distance between the third (silicone) sensor 70' and the fourth (anti-static) sensor 100. Thus, the amount of the silicone emulsion in the mix may be altered without changing the amount of the anti-static switch. When motor 76' is rotated in one direction to raise the first carriage 86, the carriage not only carries with it the third (silicone) sensor 70' but also the journalled bushing 94, the second carriage 98 and the fourth (anti static) sensor 100. The bushing 94 will merely slide up on the spline of the motor shaft 92. If, however, it is desired to move the fourth (anti static) sensor 100 with respect to the third (silicone) sensor 70', the motor 90 is energized and depending upon the direction of operation of the motor, the fourth sensor 100 carried on the carriage 98 may be moved up or down with respect to the column 98 and with respect to the other proximity sensors. Thus, the amount of the anti-static liquid can be changed relative to the other liquids in the mixing system.

It will be appreciated that although two columns 12 and 14 are illustrated and described for the first embodiment and three columns 12' 14' and 88 are illustrated and described for the second embodiment, the purpose is to prevent interference between and among the several proximity sensors. Since the "empty" sensor 66 is located well below the other sensors it may satisfactorily operate on the same column as one of the others sensors. There may be other acceptable ways to prevent such interference among the sensors thereby permitting several or perhaps all of the sensors to operate on a single liquid column.

It may be seen that the mixing system provides a very accurate and easily adjustable mean for determining the amounts of liquids charged into the mixing tank and for the most part the sensing devices are totally isolated from the mixing system avoids the need for expensive metering devices, complex counters and adjustment mechanisms and it provides a unitary mixing and discharge system which automatically mixes a batch when the previous batch has been discharged.

The foregoing has been given only by example and it will be obvious by to a person skilled in the art that various modifications may be made in the system without departing from the true spirit and scope of the invention.

What is claimed is:

1. A system for automatically preparing a batch mixture of liquids, said system comprising a liquid holding tank, a plurality of liquid columns outside of said tank and in fluid communication with said tank, whereby the level of liquid in said columns will be the same as the level of liquid in said tank, liquid level detection means outside of said tank and said columns for detecting liquid in said columns at each of several predetermined levels, said liquid level detection means including a static capacity type proximity sensor for each of said columns and for each of said predetermined levels, at least one of said sensors being vertically movable relative to another of said sensor, liquid charging means responsive to said liquid level detection means of charging separately and in seriatum a plurality of liquids into said tank, each in a predetermined quantity sufficient to raise the liquid in the column from one predetermined level to the next, and liquid transport means responsive to said liquid level detection means for mixing the liquids which have been charged into the tank and for discharging the liquid mixture from the tank after the liquids have been charged into the tank and mixed.

2. The system of the claim 1 wherein electrically operated drive means is provided for vertically moving said one of said sensors relative to said other of said sensors.

3. The system of claim 2 wherein there are first, second and third sensors and said first and second sensors are vertically movable relative to each other and relative to said third sensor and said electrically operated drive means includes a first drive means for vertically moving said first and second sensors in unison relative to said third sensor and a second drive means for moving said first and second sensors relative, to one another.

4. The system of claim 3 wherein said electrically operated drive means includes a reversible electric motor, an elongated shaft connected to said motor for rotation by said motor, said shaft having an externally threaded portion, a vertically movable first carriage carrying said first sensor and an internally threaded member affixed to said first carriage and in threaded engagement with the externally threaded portion of said shaft, whereby said first carriage and said first sensor carried thereby may be adjustably moved upwardly or downwardly depending upon the direction of operation of said motor.

5. The system of claim 4 wherein there is provided a vertically movable second carriage having an internally threaded member, said second sensor being mounted on said second carriage, a second reversible electrical motor having an elongated shaft, an externally threaded bushing surrounding said second motor shaft and mounted on and journalled for rotation relative to said first carriage, said bushing being vertically movable relative to said second motor shaft but being prevented from rotating relative thereto, said bushing being in threaded engagement with said second carriage internally threaded member, whereby when said first motor is operated said first and second carriages with said first and second sensors respectively carried thereon will be moved vertically in unison relative to said third sensor and when said second motor is operated said second carriage will be moved relative to said first carriage to move said first and second sensors relative to one another.

6. A system for automatically preparing a batch mixture of liquids, said system comprising a liquid holding tank, a plurality of non-metallic liquid columns outside of said tank and in fluid communication with said tank, whereby the level of liquid in said columns will be the same as the level of liquid in said tank, liquid level detection means outside of said tank and said columns for detecting liquid in said columns at each of several predetermined levels, said liquid level detection means including a static capacity type proximity sensor for each of said columns and for each of said predetermined levels, liquid charging means responsive to said liquid level detection means for charging separately and in seriatum a plurality of liquids into said tank, each in a predetermined quantity sufficient to raise the liquid in said columns from one predetermined level to the next, and liquid transport means responsive to said liquid level detection means responsive to said liquid level detection means for mixing the liquids which have been charged into the tank and for discharging the liquid mixture from the tank after the liquids have been charged into the tank and mixed.

7. The system of claim 6 wherein a fist one of said sensors is vertically movable relative to a second of said sensors, and electrically operated drive means is provided for vertically moving said first sensor relative said second sensor.

8. The system of claim 6 wherein there are first, second and third sensors and the first and second sensors are vertically movable relative to each other and relative to the third sensor and said electrically operated drive means includes a first drive means for vertically moving said first and second sensors in unison relative to said third sensor and a second drive means for moving said first and second sensors relative one another.

9. The system of claim 8 wherein said electrically operated drive means includes a reversible electric motor, an elongated shaft connected to said motor for rotation by said motor, said shaft having an externally threaded portion, a vertically movable first carriage carrying said first sensor and an internally threaded member affixed to said first carriage and in threaded engagement with the externally threaded portion of said shaft whereby said first carriage and said first sensor carried thereby may be adjustably moved upwardly or downwardly depending upon the direction of operation of said motor.

10. The system of claim 9 wherein there is provided a vertically movable second carriage having an internally threaded member, said second sensor being mounted on said second carriage, a second reversible electrical motor having an elongated shaft, an externally threaded bushing surrounding said second motor shaft and mounted on and journalled for rotation relative to said first carriage, said bushing being vertically movable relative to said second motor shaft but being prevented from rotating relative thereto, said bushing being in threaded engagement with said second carriage internally threaded member, whereby when said first motor is operated said first and second carriages with said first and second sensors respectively carried thereon will be moved vertically in unison relative to said third sensor and when said second motor is operated said second carriage will be moved relative to said first carriage to move said first and second sensors relative to one another.

11. In a liquid mixing system for automatically preparing a batch mixture containing predetermined quantities of liquids, said system comprising, a liquid holding tank, liquid column means comprising a pluality of liquid columns each formed of a non-metallic material and located outside of said tank and in fluid communication with said tank, whereby the level of liquid in said column means will be the same as the level of liquid in said tank, first liquid level detection means for detecting the presence of liquid in said column means at a first predetermined level, second liquid level detection means for detecting the presence of liquid in said column means at a second predetermined level above said first level, third liquid level detection means for detecting the presence of liquid in said column means at a third predetermined level above said second level, each of said liquid level detection means including a static capacity type proximity sensor for each of said liquid columns and for each of said predetermined levels, liquid transport means operable alternatively in a mix mode for mixing the liquids which have been charged into the tank and in a discharge mode for discharging the liquid mixture from the tank after the predetermined quantities of liquids have been charged into the tank and mixed together as a batch, said liquid transport means including a first conduit for removing liquid from said tank, a second conduit for returning liquid to said tank; a third conduit for discharging liquid from the system, a pump for forcibly moving liquid through said first conduit, and a valve connecting said first, second and third conduits and movable between a mix position wherein it connects said first and second conduits to recirculate and mix the liquid withdrawn from the tank when said pump means is energized, and a discharge position wherein it connects said first and third conduits to discharge from the system the liquid withdrawn from the tank when said pump means is energized, mode sensing means for sensing the operational mode of said valve, means responsive to said mode sensing means and said second liquid level detection means for initiating charging of a first liquid into said tank when liquid is not detected in said column means at said second predetermined level and said valve is in a mix position and for terminating the charging of said first liquid and initiating the charging of a second liquid into the tank when the liquid in said column means has been detected at said second predetermined level, and means responsive to said third level detection means for terminating the charging of the second liquid into the tank when liquid has been detected in the column means at said third predetermined level.

12. The liquid mixing system of claim 1 wherein there is provided conductivity detection means for detecting the electrical conductivity of the liquid in said tank, and means for charging a conductivity-altering liquid into the tank after the charging of said first liquid has begun and before the charging of said second liquid has begun and until the electrical conductivity of the mixture of said first and conductivity-altering liquids has reached a predetermined value and the liquid in the column has reached said second predetermined level.

13. The liquid mixing system for claim 11 and further including pressure sensing means operatively connected to said third conduit for sensing the pressure within said third conduit and pump control means reponsive to said pressure sensing means when said valve is in its discharge position for energizing said pump when the pressure within said third conduit is below a predetermined level and for deenergizing said pump when the pressure within said third conduit is above said level.

* * * * *